US012392266B2

(12) United States Patent
Luven et al.

(10) Patent No.: US 12,392,266 B2
(45) Date of Patent: Aug. 19, 2025

(54) HYDROGEN COMBUSTION ENGINE AND PASSENGER CAR AND COMMERCIAL VEHICLE

(71) Applicant: MAHLE International GmbH, Stuttgart (DE)

(72) Inventors: Christoph Luven, Stuttgart (DE); Alexander Mueller, Metzingen (DE); Alexander Puck, Esslingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 18/213,887

(22) Filed: Jun. 26, 2023

(65) Prior Publication Data

US 2024/0229687 A1 Jul. 11, 2024

(30) Foreign Application Priority Data

Jun. 24, 2022 (DE) ..... 10 2022 206 387.2

(51) Int. Cl.
*F01L 3/14* (2006.01)
*F01L 3/20* (2006.01)

(52) U.S. Cl.
CPC .. *F01L 3/14* (2013.01); *F01L 3/20* (2013.01)

(58) Field of Classification Search
CPC ..... F01L 3/14; F01L 3/20; F01L 3/02; F01L 3/04; F01L 3/22
See application file for complete search history.

(56) References Cited

U.S. PATENT DOCUMENTS 8,230,834 B2 * 7/2012 Endo ..... F01L 3/14 29/888.45
2014/0239218 A1 * 8/2014 Kroos ..... B60G 21/0555 251/366
2016/0326919 A1 * 11/2016 Ikemi ..... F01L 3/18
2017/0204752 A1 7/2017 Kroos
(Continued)

FOREIGN PATENT DOCUMENTS

DE 102013213268 A1 1/2015
DE 102014202021 A1 * 8/2015 ..... B23P 15/001
(Continued)

OTHER PUBLICATIONS

German Search Report for DE-102022206387.2, dated Mar. 30, 2023.
English abstract for DE-102013213268.

*Primary Examiner* — Grant Moubry
(74) *Attorney, Agent, or Firm* — Fishman Stewart PLLC

(57) ABSTRACT

A hydrogen combustion engine for a passenger car is disclosed. The hydrogen combustion engine includes at least one cylinder having a combustion chamber and a metallic hollow valve for the introduction of hydrogen into the combustion chamber or for directing water out from the combustion chamber. The hollow valve comprises a tubular valve shaft extending along an axial direction, which along the axial direction passes over into a valve plate with an enlarged external diameter compared to the valve shaft. The valve shaft and the valve plate delimit a cavity, wherein a cavity diameter of the cavity, measured transversely to the axial direction in the region of the valve shaft is between 3.2 mm and 4.4 mm. A wall thickness of the hollow valve, measured transversely to the axial direction in the region of the valve shaft is between 0.8 mm and 1.4 mm.

20 Claims, 2 Drawing Sheets

(56) References Cited

U.S. PATENT DOCUMENTS

| | | | | |
|---|---|---|---|---|
| 2020/0232354 | A1* | 7/2020 | Heckendorn et al. | F01L 3/14 |
| 2021/0270154 | A1* | 9/2021 | Kunitake | F01L 3/14 |
| 2022/0152690 | A1* | 5/2022 | Thorsten | B21J 7/14 |

FOREIGN PATENT DOCUMENTS

| | | | | | |
|---|---|---|---|---|---|
| DE | 102016200739 | A1 | | 7/2017 | |
| DE | 102017202585 | A1 | | 8/2017 | |
| JP | 2006125277 | A | | 5/2006 | |
| JP | 2014169696 | A | * | 9/2014 | B60G 21/0555 |

* cited by examiner

HYDROGEN COMBUSTION ENGINE AND PASSENGER CAR AND COMMERCIAL VEHICLE

CROSS-REFERENCE TO RELATED APPLICATION

This application claims priority to German Application No. DE 10 2022 206 387.2 filed on Jun. 24, 2022, the contents of which are hereby incorporated by reference in its entirety.

TECHNICAL FIELD

The invention relates to a hydrogen combustion engine for a passenger car and for a commercial vehicle. The invention further relates to a passenger car and a commercial vehicle, respectively with such a hydrogen combustion engine.

BACKGROUND

A hydrogen combustion engine is a combustion engine which is operated with hydrogen as fuel. It converts chemical energy into mechanical work and heat. The basis for this is the so-called oxyhydrogen reaction, in which the hydrogen is burned. The autoignition temperature of the hydrogen lies at close to 600°. Therefore, particularly high thermal loads occur in the inlet- and outlet valves of the hydrogen combustion engine. This makes it necessary to cool said valves particularly effectively. It is known from conventional combustion engines for passenger cars and commercial vehicles, which operate with petrol fuel or with diesel fuel, to design said valves as so-called metallic hollow valves which have an internal liquid cooling medium. It generally applies for metallic hollow valves that these have a lower net weight than solid valves and, owing to said filling with a cooling medium, permit an improved heat dissipation.

It is therefore an object of the present invention to indicate new ways in the development of hydrogen combustion engines.

SUMMARY

This problem is solved according to the invention by the subject of the independent claim(s). Advantageous embodiments are the subject of the dependent claims.

Accordingly, a basic idea of the invention is to also equip the inlet- and outlet valves also of a hydrogen combustion engine, just as conventional combustion engines based on petrol or diesel fuel, with a metallic hollow valve which has a cavity which is able to be filled with a cooling medium. A dimensioning of the cavity, adapted to the characteristics of the hydrogen as fuel and, related thereto, also to the wall thickness of the sections of the hollow valve delimiting the cavity, is essential to the invention here.

It has been shown that with this dimensioning it must be taken into account in particular whether the hydrogen combustion engine is used in a passenger car (automobile) or in a commercial vehicle—in the latter, the hydrogen engine and thus also its valves—is exposed to increased thermal loads. Extensive experimental investigations have shown that a particularly effective cooling of the hollow valve is achieved in a hydrogen combustion engine for an automobile when a cavity diameter of the cavity in the region of the valve shaft is between 3 mm and 4.4 mm, and furthermore a wall thickness of the hollow valve in the region of the valve shaft is between 0.8 mm and 14 mm. Both characteristics together bring about an effective dissipation of heat from the hollow valve, in particular when a suitable cooling medium is provided in the cavity. If the hydrogen combustion engine is to be used in a commercial vehicle, then with the increased mechanical and thermal loads occurring there, an optimum cooling of the hollow valve is achieved when the cavity diameter of the cavity in the region of the valve shaft is between 3.5 mm and 7 mm and furthermore the wall thickness of the hollow valve in the region of the valve shaft is between 1.5 mm and 3.0 mm.

In detail according to a first aspect of the invention a hydrogen combustion engine according to the invention for a passenger car comprises at least one cylinder, which comprises a combustion chamber for the combustion of hydrogen to water. Furthermore, the hydrogen combustion engine according to the invention comprises a metallic hollow valve for the introduction of hydrogen into the combustion chamber or for the directing of water out from the combustion chamber. The hollow valve therefore functions in the former case as an inlet valve and in the latter case as an outlet valve. In the present instance, "metallic" means that the material both of the valve shaft and also of the valve plate is or comprises a metal. The hollow valve comprises a tubular valve shaft extending along an axial direction, which passes over along the axial direction into a valve plate with an enlarged external diameter compared to the valve shaft. The valve shaft and the valve plate together delimit a cavity. A cavity diameter of the cavity, measured transversely to the axial direction, in the region of the valve shaft is between 3 mm and 4.4 mm. A wall thickness of the hollow valve, measured transversely to the axial direction, in the region of the valve shaft is between 0.8 mm and 1.4 mm, preferably approximately 1 mm.

In a preferred embodiment, the cavity diameter, measured transversely to the axial direction, in the region of the valve plate is greater than cavity diameter in the region of the valve shaft. Thus, the increased volume compared to the valve shaft can be utilized for the cavity, so that on filling with a cooling medium the heat dissipation is further improved.

In a further preferred embodiment, a wall thickness of the hollow valve in the region of the valve plate corresponds substantially to a wall thickness in the region of the valve shaft, or is smaller than this wall thickness. A combination, in part, of both variants is also conceivable, which means that the wall thickness in the region of the valve shaft has, in part, the same value as the wall thickness in the region of the valve plate and, in part, has a smaller value than in the region of the valve plate.

Furthermore, according to a second aspect of the invention, a hydrogen combustion engine according to the invention for a commercial vehicle has at least one cylinder which comprises a combustion chamber for the combustion of hydrogen to water. Furthermore, the hydrogen combustion engine according to the invention comprises a metallic hollow valve for the introduction of hydrogen into the combustion chamber or for the directing of water out from the combustion chamber. The hollow valve therefore functions in the former case as an inlet valve and in the latter case as an outlet valve. In the present instance, "metallic" means that the material both of the valve shaft and also of the valve plate comprises or is a metal. The hollow valve comprises a tubular valve shaft, extending along an axial direction, which passes over along the axial direction into a valve plate with an enlarged external diameter compared to the valve shaft. The valve shaft and the valve plate together delimit a cavity. A cavity diameter of the cavity, measured transversely to the axial direction, in the region of the valve shaft is between 3.5 mm and 7 mm. A wall thickness of the hollow valve, measured transversely to the axial direction, in the region of the valve shaft is between 1.5 mm and 3.0 mm, preferably approximately 2 mm.

In a preferred embodiment of the hydrogen combustion engine according to the invention in accordance with the second aspect, the cavity diameter, measured transversely to the axial direction, in the region of the valve plate is greater than cavity diameter in the region of the valve shaft. Thus, the enlarged volume compared to the valve shaft can be utilized for the cavity, so that on filling with a cooling medium, the heat dissipation is further improved.

According to an advantageous further development, a wall thickness of the hollow valve's cavity of the hydrogen combustion engine according to the invention in accordance with the second aspect in the region of the valve plate corresponds substantially to the wall thickness in the region of the valve shaft or is smaller than this wall thickness. A combination, in part, of both variants is also conceivable, which means that the wall thickness in the region of the valve shaft has, in part, the same value as the wall thickness in the region of the valve plate and, in part, a smaller value than in the region of the valve plate.

Expediently in the case of the hollow valve of the hydrogen combustion engine according to the invention in accordance with the first or second aspect, the cavity is at least partially, preferably partially but not completely, filled with a cooling medium. This permits a particularly effective dissipation of the heat received by the hollow valve in the region of the valve plate from the combustion chamber of the internal combustion engine by means of the cooling medium.

Particularly preferably, the cooling medium can be, or comprise, sodium. Alternatively thereto, the cooling medium can be a non-evaporable getter alloy, which contains at least one of the following components: zirconium; vanadium; iron; manganese; at least one rare earth metal.

According to an advantageous further development of the hydrogen combustion engine according to the invention in accordance with the first or second aspect, the at least one cylinder can have a sintered valve seat ring surrounding a valve opening, against which valve seat ring the valve plate of the hollow valve can lie or respectively lies in a closed position of the hollow valve. Particularly preferably, the valve seat ring can comprise a cobalt-based hard phase. In this way, a high wear resistance of the valve seat ring can be achieved.

According to an advantageous further development, the hard phase can contain molybdenum, chromium and iron as further components. Thereby, the hardness of the valve seat ring is further improved, whereby the wear resistance also further increases. Alternatively thereto, but also preferably, the hard phase can comprise molybdenum, chromium and vanadium as further components. This also increases the hardness of the valve seat ring additionally, whereby the wear resistance also further increases.

According to an advantageous further development, the hollow valve can have in the region of the valve plate a contact section for lying against the valve seat ring in the closed position. In the region of the contact section, the hollow valve is formed in a plated manner. Such a plating of the contact section can preferably be produced by means of plasma powder build-up welding, particularly preferably with the use of iron or cobalt as filler material. This provision brings about a further improved wear resistance of the hollow valve.

The invention further relates to a passenger car with a hydrogen combustion engine, presented above, according to the invention in accordance with the first aspect, so that the advantages of the hydrogen combustion engine according to the invention in accordance with the first aspect are transferred to the passenger car according to the invention.

The invention further relates to a commercial vehicle with a hydrogen combustion engine, presented above, according to the invention in accordance with the second aspect, so that the advantages of the hydrogen combustion engine according to the invention in accordance with the second aspect are transferred to the commercial vehicle according to the invention.

Further important features and advantages of the invention will emerge from the subclaims, from the drawing and from the associated figure description with the aid of the drawing.

It shall be understood that the features mentioned above and to be explained further below are able to be used not only in the respectively indicated combination, but also in other combinations or in isolation, without departing from the scope of the present invention.

BRIEF DESCRIPTION OF THE DRAWINGS

Preferred example embodiments of the invention are represented in the drawing and are explained more closely in the following description, wherein the same reference numbers refer to identical or similar or functionally identical components.

DETAILED DESCRIPTION

Figure 1:
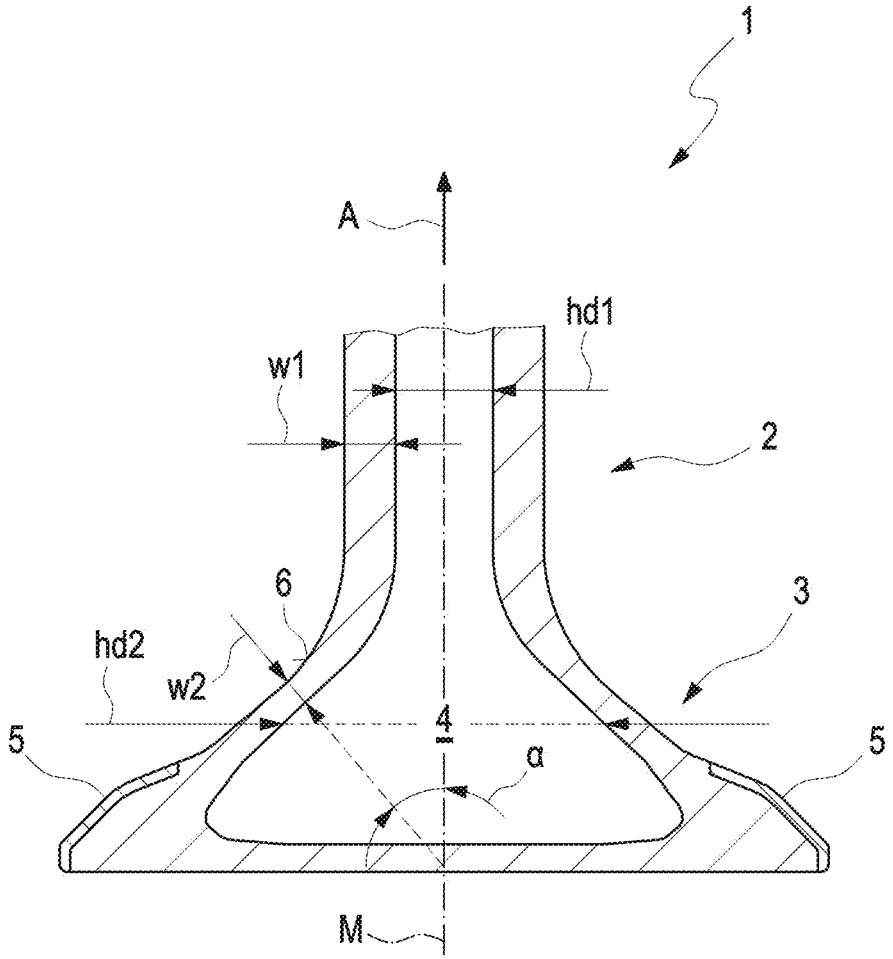
FIG. 1 shows an exemplary metallic hollow valve of a hydrogen combustion engine.

The single FIG. 1 shows by way of example the structure of the metallic hollow valve 1 of a hydrogen combustion engine according to the invention both in accordance with the first and also second aspect. The metallic hollow valve 1 serves for the introduction of hydrogen into the combustion chamber or for directing burned hydrogen out from the combustion chamber. According to FIG. 1, the hollow valve 1 comprises a tubular valve shaft 2, extending along an axial direction A, which along the axial direction A passes over into a valve plate 3—also known to the relevant person skilled in the art as a "valve head"—with an enlarged external diameter compared to the valve shaft 2, measured radially, therefore perpendicularly to the axial direction A. The axial direction A extends along a central longitudinal axis M of the hollow valve. The valve shaft 2 and the valve plate 3 are formed integrally with respect to one another. The valve plate 3 and the valve shaft 2 can be produced by means of forging or by means of electrochemical machining.

The valve shaft 2 and the valve plate 3 delimit together a cavity 4. A cavity diameter hd2, measured transversely to the axial direction A, in the region of the valve plate 3 is greater according to FIG. 1 than the cavity diameter hd1 in the region of the valve shaft 2. If the concern is with a hydrogen combustion engine in accordance with the first aspect, a cavity diameter of the cavity 4, measured transversely to the axial direction A, in the region of the valve shaft is between 3.0 mm and 4.4 mm. A wall thickness w1 of the hollow valve 1, measured transversely to the axial direction A, in the region of the valve shaft 2 is between 0.8 mm and 1.4 mm, preferably approximately 1 mm. A wall thickness w2 of the hollow valve 1 in the region of the valve plate 3 corresponds substantially to the wall thickness w1 in the region of the valve shaft 2, but can also be smaller than this. FIG. 1 illustrates a combination of both variants, which means that the wall thickness w2 corresponds, in part, to the value of the wall thickness w1 and, in part, is smaller than the wall thickness w1. As FIG. 1 shows, the wall thickness w2 is measured here perpendicularly to the surface 6 of the valve plate 3, therefore at an acute angle a to the axial direction, A.

If the hollow valve 1 is to be used in a hydrogen combustion engine in accordance with the second aspect, the cavity diameter hd1 of the cavity 4, measured transversely to the axial direction A, of the cavity 4 in the region of the valve shaft is between 3.5 mm and 7 mm. The wall thickness w2 of the hollow valve 1, measured transversely to the axial direction A, in the region of the valve shaft 2 is then between 1.5 mm and 3.0 mm, preferably approximately 2 mm.

The hollow valve 1 illustrated in FIG. 1 can be used as part of a valve train in a hydrogen combustion engine in accordance with the first or second. The following explanations concerning the hollow valve 1 apply both when the latter is used in the hydrogen combustion engine in accordance with the first aspect and also when it is used in the hydrogen combustion engine in accordance with the second aspect. The cavity 4 of the hollow valve 1 can thus be filled in both cases partially with a cooling medium, for example with sodium. Instead of sodium, in both variants the cooling medium can also be formed by a non-evaporable getter alloy, zirconium, vanadium, iron, manganese or at least one rare earth metal.

Figure 2:
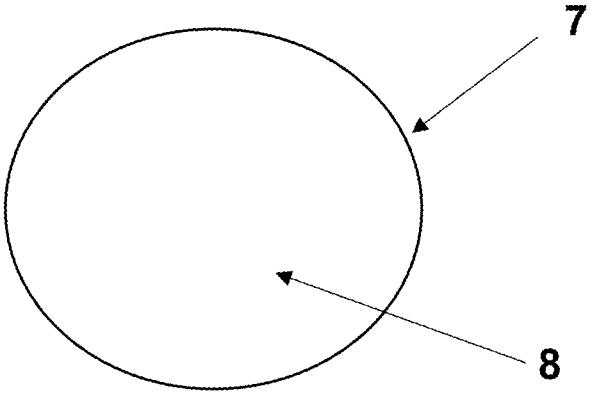
FIG. 2 shows a schematic representation of a valve seat ring surrounding a valve opening.

Both in the case of the hydrogen combustion engine in accordance with the first aspect and also in the case of that in accordance with the second aspect, the cylinder can have a sintered valve seat ring 7 surrounding a valve opening 8, as schematically shown in FIG. 2. The valve plate of the hollow valve lies in a closed position against this valve seat ring with a contact section 5 of the hollow valve 1. Said contact section 5, which is indicated merely schematically in FIG. 1, is exposed to particular mechanical and thermal loads in operation of the valve train in the hydrogen combustion engine. The valve seat ring can comprise a cobalt-based hard phase, which contains molybdenum, chromium and iron as further components. The use of a cobalt-based hard phase is also conceivable with contains molybdenum, chromium and vanadium as further components.

The hollow valve 1 can be formed in a plated manner at least in the region of the contact section 5. Such a plating of the contact section 5 can preferably be produced by means of plasma powder build-up welding, particularly preferably with the use of iron (Fe) or cobalt (Co) as filler material.

The invention claimed is:

1. A hydrogen combustion engine for a passenger car, comprising at least one cylinder having a combustion chamber, a metallic hollow valve for the introduction of hydrogen into the combustion chamber or/and for directing exhaust gas out from the combustion chamber, wherein the hollow valve comprises a tubular valve shaft extending along an axial direction, which along the axial direction passes over into a valve plate with an enlarged external diameter compared to the valve shaft, wherein the valve shaft and the valve plate delimit a cavity, wherein a cavity diameter of the cavity, measured transversely to the axial direction, in a region of the valve shaft is between 3.0 mm and 4.4 mm, wherein a wall thickness of the hollow valve, measured transversely to the axial direction in the region of the valve shaft is between 0.8 mm and 1.4 mm, wherein the cavity is at least partially filled with a cooling medium, and wherein in addition to the cooling medium, a non-evaporable getter alloy is present, which contains at least one of the following components:

zirconium, vanadium, iron manganese, and at least one rare earth metal.

2. The hydrogen combustion engine according to claim 1, wherein a cavity diameter, measured transversely to the axial direction in a region of the valve plate is greater than the cavity diameter, measured transversely to the axial direction in the region of the valve shaft.

3. The hydrogen combustion engine according to claim 1, wherein a wall thickness of the hollow valve in the region of the valve plate corresponds at least in part substantially to the wall thickness in the region of the valve shaft or is smaller than the wall thickness in the region of the valve shaft.

4. The hydrogen combustion engine according to claim 1, wherein the wall thickness of the hollow valve, measured transversely to the axial direction in the region of the valve shaft, is approximately 1 mm.

5. The hydrogen combustion engine according to claim 1, wherein the cooling medium is or contains sodium.

6. A passenger car, comprising a body and a hydrogen combustion engine according to claim 1.

7. A hydrogen combustion engine for a commercial vehicle, comprising:

at least one cylinder having a combustion chamber, a metallic hollow valve for the introduction of hydrogen into the combustion chamber or/and for directing exhaust gas out from the combustion chamber, wherein the hollow valve comprises a tubular valve shaft extending along an axial direction, which along the axial direction passes over into a valve plate with an enlarged external diameter compared to the valve shaft, wherein the valve shaft and the valve plate delimit a cavity, wherein a cavity diameter of the cavity, measured transversely to the axial direction in a region of the valve shaft is between 3.5 mm and 7 mm, wherein a wall thickness of the hollow valve, measured transversely to the axial direction in the region of the valve shaft is between 1.5 mm and 3.0 mm, wherein the cavity is at least partially filled with a cooling medium, and wherein in addition to the cooling medium, a non-evaporable getter alloy is present, which contains at least one of the following components:

zirconium, vanadium, iron manganese, and at least one rare earth metal.

8. The hydrogen combustion engine according to claim 7, wherein the cavity diameter, measured transversely to the axial direction in the region of the valve plate is greater than the cavity diameter, measured transversely to the axial direction in the region of the valve shaft.

9. The hydrogen combustion engine according to claim 7, wherein the wall thickness of the hollow valve in the region of the valve plate corresponds in part substantially to the wall thickness in the region of the valve shaft or is smaller than the wall thickness in the region of the valve shaft.

10. The hydrogen combustion engine according to claim 7, wherein the cooling medium is or contains sodium.

11. The hydrogen combustion engine according to claim 7, wherein the cylinder comprises a sintered or cast valve seat ring, surrounding a valve opening, the valve plate lying against the valve seat ring in a closed position of the hollow valve.

12. The hydrogen combustion engine according to claim 11, wherein the valve seat ring comprises a cobalt-based hard phase.

13. The hydrogen combustion engine according to claim 12, wherein the cobalt-based hard phase contains molybdenum, chromium and iron as further components.

14. The hydrogen combustion engine according to claim 12, wherein the cobalt-based hard phase contains molybdenum, chromium and vanadium as further components.

15. A commercial vehicle, comprising a body and a hydrogen combustion engine according to claim 7.

16. The hydrogen combustion engine according to claim 7, wherein the wall thickness of the hollow valve, measured transversely to the axial direction in the region of the valve shaft, is approximately 2 mm.

17. A hydrogen combustion engine for a commercial vehicle, comprising:

at least one cylinder comprising a combustion chamber and a sintered or cast valve seat ring, surrounding a valve opening, a metallic hollow valve for the introduction of hydrogen into the combustion chamber or/and for directing exhaust gas out from the combustion chamber, wherein the hollow valve comprises a tubular valve shaft extending along an axial direction, which along the axial direction passes over into a valve plate with an enlarged external diameter compared to the valve shaft, wherein the valve shaft and the valve plate delimit a cavity, wherein a cavity diameter of the cavity, measured transversely to the axial direction in a region of the valve shaft is between 3.5 mm and 7 mm, wherein a wall thickness of the hollow valve, measured transversely to the axial direction in the region of the valve shaft is between 1.5 mm and 3.0 mm wherein the valve plate lies against the valve seat ring in a closed position of the hollow valve, and wherein the valve seat ring comprises a cobalt-based hard phase.

18. The hydrogen combustion engine according to claim 17, wherein the cobalt-based hard phase contains molybdenum, chromium and iron as further components.

19. The hydrogen combustion engine according to claim 17, wherein the cobalt-based hard phase contains molybdenum, chromium and vanadium as further components.

20. The hydrogen combustion engine according to claim 17, wherein a non-evaporable getter alloy is present in the cavity, which contains at least one of the following components:

zirconium,
vanadium,
iron
manganese, and
at least one rare earth metal.

* * * * *